US008147676B2

(12) United States Patent
Siskin et al.

(10) Patent No.: US 8,147,676 B2
(45) Date of Patent: Apr. 3, 2012

(54) DELAYED COKING PROCESS

(75) Inventors: Michael Siskin, Randolph, NJ (US); David T. Ferrughelli, Flemington, NJ (US); Martin L. Gorbaty, Westfield, NJ (US); Simon R. Kelemen, Annandale, NJ (US); Leo D. Brown, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1709 days.

(21) Appl. No.: 11/256,728

(22) Filed: Oct. 21, 2005

(65) Prior Publication Data

US 2006/0060506 A1 Mar. 23, 2006

Related U.S. Application Data

(63) Continuation-in-part of application No. 10/293,373, filed on Nov. 12, 2002, now abandoned.

(60) Provisional application No. 60/336,778, filed on Dec. 4, 2001.

(51) Int. Cl.
*C10B 55/00* (2006.01)

(52) U.S. Cl. ..... 208/50; 208/53; 208/131; 208/132

(58) Field of Classification Search ..... None
See application file for complete search history.

(56) References Cited

U.S. PATENT DOCUMENTS 5,258,115 A * 11/1993 Heck et al. ..... 208/131
7,303,664 B2 * 12/2007 Siskin et al. ..... 208/131

FOREIGN PATENT DOCUMENTS

GB 844698 * 8/1960

* cited by examiner

*Primary Examiner* — Tam M Nguyen
(74) *Attorney, Agent, or Firm* — Malcom D. Keen; Glenn T. Barrett

(57) ABSTRACT

The present invention relates to an improved delayed coking process. A coker feed, such as a vacuum resid, is treated with (i) a metal-containing agent and (ii) an oxidizing agent. The feed is treated with the oxidizing agent at an oxidizing temperature. The oxidized feed is then pre-heated to coking temperatures and conducted to a coking vessel for a coking time to allow volatiles to evolve and to produce a substantially free-flowing coke. A metals-containing composition is added to the feed at at least one of the following points in the process: prior to the heating of the feed to coking temperatures, during such heating, and/or after such heating.

18 Claims, 1 Drawing Sheet

Oxidized Residuum

Discrete Domains (2-5μm)

Unoxidized Residuum

Flow Domains (10-30 μm)

DELAYED COKING PROCESS

CROSS REFERENCE TO RELATED APPLICATIONS

This application is a continuation-in-part of U.S. patent application Ser. No. 10/293,373 filed Nov. 12, 2002 now abandoned, which claims benefit of U.S. Provisional Patent Application No. 60/336,778 filed Dec. 4, 2001.

FIELD OF THE INVENTION

The present invention relates to a delayed coking process. A coker feed, such as a vacuum residuum, is treated with (i) a metal-containing agent and (ii) an oxidizing agent. The feed is treated with the oxidizing agent at an oxidizing temperature. The oxidized feed is then pre-heated to coking temperatures and conducted to a coking vessel for a coking time to allow volatiles to evolve and to produce a substantially free-flowing coke. A metals-containing composition is added to the feed at at least one of the following points in the process: prior to the heating of the feed to coking temperatures, during such heating, and/or after such heating.

BACKGROUND

Delayed coking is a process for the thermal conversion of heavy oils such as petroleum residua (also referred to as "resid") to produce liquid and vapor hydrocarbon products and coke. Delayed coking of resids from heavy and heavy sour (high sulfur) crude oils is carried out by converting part of the resids to more valuable hydrocarbon products. The resulting coke has value, depending on its grade, as a fuel (fuel grade coke), electrodes for aluminum manufacture (anode grade coke), etc.

In the delayed coking process, the feed is rapidly heated in a fired heater or tubular furnace. The heated feed is conducted to a coking vessel (also called a "drum") that is maintained at conditions under which coking occurs, generally at temperatures above about 400° C. and super-atmospheric pressures. The heated feed forms volatile species including hydrocarbons that are removed from the drum overhead and conducted away from the process to, e.g., a fractionator. The process also results in the accumulation of coke in the drum. When the coker drum is full of coke, the heated feed is switched to another drum and hydrocarbon vapors are purged from the coke drum with steam. The drum is then quenched with water to lower the temperature from about 200° F. to about 300° F., after which the water is drained. When the cooling step is complete, the drum is opened and the coke is removed after drilling and/or cutting using high velocity water jets. The coke removal step is frequently referred to as "decoking".

The coke is typically cut from the drum using a high speed, high impact water jet. A hole is typically bored in the coke from water jet nozzles located on a boring tool. Nozzles oriented horizontally on the head of a cutting tool cut the coke from the drum. The coke removal step adds considerably to the throughput time of the process. Drilling and removing coke from the drum takes approximately 1 to 6 hours, and the coker drum is not available for feed coking until the coke removal step is completed, which unfavorably impacts the yield of hydrocarbon vapor from the process. Thus, it would be desirable to be able to produce a free-flowing coke, in a coker drum, that would not require the expense and time associated with conventional coke removal.

An additional difficulty that may arise results from the potential for non-uniform coke cooling prior to decoking, a problem sometimes called a "hot drum." Hot drums occur when, following water quench, regions of the coke volume in the drum remain at a significantly higher temperature than other regions. Hot drum may result during cutting or drilling from the presence of different coke morphologies (e.g., shot and needle, shot and sponge) in different regions of the drum. As a result of the different thermal characteristics among the coke morphologies, some coke regions in the drum may differ in temperature significantly from other regions, which can lead to unpredictable and even hazardous conditions during decoking. Since free-flowing coke morphologies cool faster than agglomerated coke morphologies, it would be desirable to produce predominantly free-lowing coke in a delayed coker, in order to avoid or minimize hot drums.

SUMMARY OF THE INVENTION

In an embodiment, the invention relates to an improved delayed coking process comprising:

a) adding an oxidizing agent to an oleaginous feed and maintaining the feed at an oxidizing temperature for an oxidizing time sufficient to significantly increase the amount of asphaltenes and organically-bound oxygen in the feed in order to make an oxidized feed;
b) pre-heating the oxidized feed to a pre-heat temperature;
c) conducting the pre-heated oxidized feed to a coking vessel and coking the pre-heated oxidized feed in the vessel at a coking pressure and a coking temperature for a coking time;
d) conducting volatiles away from the process; and
e) after the coking time, removing a substantially free-flowing coke from the vessel;

wherein a metal-containing agent is added to the feed at at least one of (i) prior to step (a), (ii) during step (a), (iii) after step (a) but before step (b), (iv) during step (b), (v) after step (b) but before step (c), and/or (vi) during step (c).

In an embodiment, the process further comprises the step of quenching the free-flowing coke in the vessel with water before the removing of the coke from the vessel.

In an embodiment, the oxidizing temperature ranges from about 150° C. to about 375° C. The oxidizing agent can be air, for example. The oxidizing time generally ranges from about 20 minutes to about 5 hours.

In an embodiment, the metals-containing agent is added to the feed at a feed temperature ranging from about 70° C. to about 500° C., preferably from about 150° C. to about 500° C., and more preferably from about 185° C. to about 500° C. Preferred agents include one or more of metal hydroxides, naphthenates and/or carboxylates, metal acetylacetonates, a metal sulfide, metal acetate, metal carbonate, high surface area metal-containing solids, inorganic oxides and salts of oxides. Salts that are basic are more preferred In an embodiment, one or more caustic species can be added to the oxidized feed before, during, or after heating in the coker furnace.

In an embodiment, pressure during pre-heat ranges from about 50 psig to about 550 psig, and pre-heat temperature ranges from about 480° C. to about 520° C. Coking pressure in the drum ranges from about 15 psig to about 80 psig, and coking temperature ranges from about 410° C. and 475° C. The coking time ranges from about 0.5 hour to about 14 hours.

DETAILED DESCRIPTION OF THE INVENTION

Figure 2:
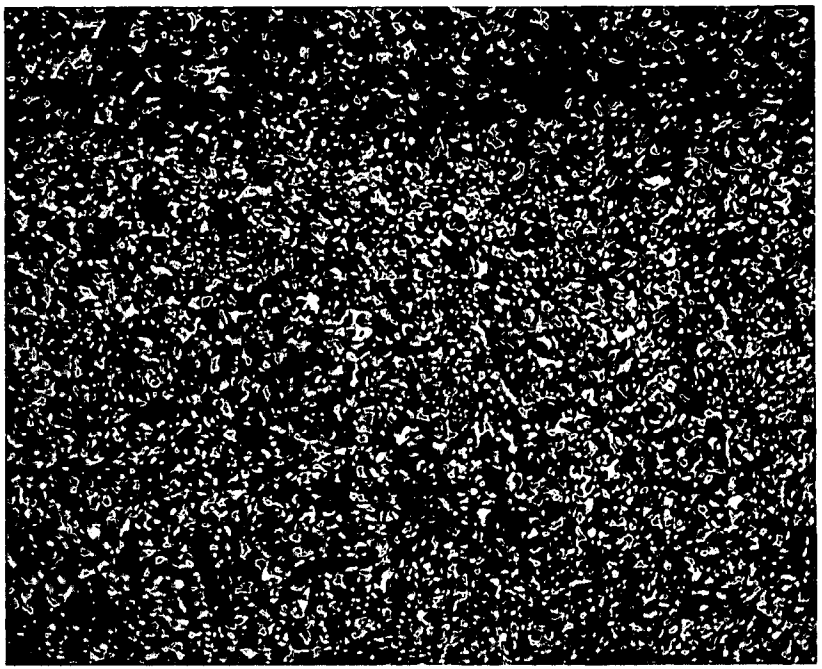
FIG. 2 hereof is a photomicrograph of coke resulting from a San Joaquin Valley vacuum residuum that was treated with air for 3 hours at a temperature from about 185° C. to about 225° C. prior to coking. The area of view is 170 microns by 136 microns. Discrete mosaic domains of 2-5 microns are indicative of shot coke morphology.

Feeds suitable for the delayed coking process include oleaginous feeds such as heavy oils. Petroleum atmospheric residua and petroleum vacuum residua can be used. Such petroleum residua are frequently obtained after removal of distillates from crude feeds under vacuum and are characterized as being comprised of components of large molecular size and weight, generally containing: (a) asphaltenes and other high molecular weight aromatic structures; (b) metallic species; and (c) sulfur-containing and nitrogen-containing species.

In an embodiment, resid feedstocks include but are not limited to residues from the atmospheric and vacuum distillation of petroleum crudes or the atmospheric or vacuum distillation of heavy oils, visbroken resids, tars from deasphalting units or combinations of these materials. Atmospheric and vacuum topped heavy bitumens can also be employed. Typically, such feedstocks are high-boiling hydrocarbonaceous materials having a nominal initial boiling point of about 525° C. or higher, an API gravity of about 20° or less, and a Conradson Carbon Residue content of about 0 to about 40 weight percent.

The resid feed is subjected to delayed coking. Generally, in delayed coking, a residue fraction, such as a petroleum residuum feed is pumped to a pre-heater at a pressure of about 50 psig to about 550 psig, where it is pre-heated to a temperature from about 480° C. to about 520° C. The pre-heated feed is conducted to a coking zone, typically a vertically-oriented, insulated coker vessel, e.g., drum, through an inlet at the base of the drum. Pressure in the drum is usually relatively low, such as about 15 to about 80 psig to allow volatiles to be removed overhead. Typical operating temperatures of the drum will be between about 410° C. and about 475° C. The hot feed thermally cracks over a period of time (the "coking time") in the coker drum, liberating volatiles composed primarily of hydrocarbon products that continuously rise through the coke mass and are collected overhead. The volatile products are conducted to a coker fractionator for distillation and recovery of coker gases, gasoline boiling range material such as coker naphtha, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. In addition to the volatile products, delayed coking also forms solid coke product.

Conventional coke processing aids can be used, including the use of antifoaming agents. The process is compatible with processes such as those disclosed in U.S. Pat. No. 3,960,704 (incorporated herein by reference) which use air-blown feed in a delayed coking process operated at conditions that will favor the formation of isotropic coke.

The volatile products from the coker drum are conducted away from the process for storage or further processing. For example, volatiles can be conducted to a coker fractionator for distillation and recovery of coker gases, coker naphtha, light gas oil, and heavy gas oil. Such fractions can be used, usually but not always following upgrading, in the blending of fuel and lubricating oil products such as motor gasoline, motor diesel oil, fuel oil, and lubricating oil. Upgrading can include separations, heteroatom removal via hydrotreating and non-hydrotreating processes, de-aromatization, solvent extraction, and the like. The process is compatible with processes disclosed in U.S. Pat. No. 3,116,231 (incorporated by reference herein) where at least a portion of the heavy coker gas oil present in the product stream introduced into the coker fractionator is captured for recycle and combined with the fresh feed (coker feed component), thereby forming the coker heater or coker furnace charge. The combined feed ratio ("CFR") is the volumetric ratio of furnace charge (fresh feed plus recycle oil) to fresh feed to the continuous delayed coker operation. Delayed coking operations typically employ recycles of about 5 vol. % to about vol.25% (CFRs of about 1.05 to about 1.25). In some instances there is 0 recycle and sometimes in special applications recycle up to 200%. CFRs should be low to aid in free-flowing shot coke formation, and preferably no recycle should be used.

There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Shot coke is considered the lowest quality coke. The term "shot coke" comes from its shape, which is similar to that of BB-sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke or composed of mixture of shot coke bonded to sponge coke. For example, coke that has a mostly sponge-like physical appearance, but with evidence of small shot spheres beginning to form as discrete shapes.

It has been discovered that a substantially free-flowing coke can be produced by adding to the feed a metal-containing composition and an oxidizing agent. While not wishing to be bound by any theory or model, it is believed that such oxidizing agent substantially increases the contents of its asphaltene, and/or polars fractions, such as those containing organically bound oxygen like ketones, carboxylic acids, etc. By the term "substantially free-flowing" it is meant that at least 50% of the coke, preferably at least 80% of the coke, and most preferably over 90% of the coke is loose free-flowing coke. This coke requires minimal or no drilling before emptying the drum.

In one aspect of the process, the feed is subjected to an oxidizing agent at an oxidizing temperature for an oxidizing time effective for forming asphaltenes and organically-bound oxygen groups. Oxidizing time generally ranges from about 30 minutes to about 5 hours. Oxidizing temperatures will typically be from about 150° C. to about 325° C., preferably from about 185° C. to about 280° C., and more preferably from about 185° C. to about 250° C. The oxidizing agent can be in any suitable form including gas, liquid or solid. Non-limiting examples of oxidizing agents that can be used in the practice of the present invention include air, oxygen, ozone, hydrogen peroxide, organic peroxides, hydroperoxides, inorganic peracids, inorganic oxides and peroxides and salts of oxides, sulfuric acid, and nitric acid. Air is preferred.

In a related embodiment, after the feed is treated with the oxidizing agent, one or more caustic species, preferably a spent caustic, can be added. The spent caustic can also be added before, during, or after the oxidized resid is passed to the coker furnace and heated to coking temperatures. The caustic will be an alkali-metal material, preferably a spent caustic soda and/or potash stream that is typically used in various refinery processes. Such spent caustic streams typically contain one or more of sodium and potassium, sulfur, and other wastes, including organic contaminants that vary depending on the hydrocarbon source but can be organic acids, dissolved hydrocarbons, phenols, naphthenic acids, and salts of organic acids, phenols and naphthenic acids. The spent caustic stream will usually have a relatively high water content, typically about 50 wt. % to about 95 wt. % water, more typically from about 65 wt. % to about 80 wt. %. Preferably, a caustic species is added to the resid coker feedstock. When used, the caustic species may be added (i) before, during, or after heating the feed to oxidizing temperature, and/or (ii) before, during, or after pre-heating in the coker furnace. Addition of caustic will reduce the Total Acid Number (TAN) of the resid coker feedstock and also convert naphthenic acids to metal naphthenates, e.g., sodium naphthenate.

The precise conditions of oxidizing temperature and oxidizing time are feed and agent dependent. That is, the conditions at which the feed is treated with the oxidizing agent is dependent on the composition and properties of the feed to be coked. The following procedure can be used. First, several samples of the feed are obtained and each is tested at different oxidizing times and temperatures followed by coking in a Microcarbon Residue test unit. The resulting coke is then analyzed by use of conventional microcarbon test procedures and microscopy. The desired coke morphology that will produce substantially free-flowing coke is a coke microstructure of discrete micro-domains having an average size of about 0.5 to about 10 μm, preferably from about 1 to about 5 μm, somewhat like a mosaic (FIG. 2 hereof). Coke microstructure that represents coke that is not free-flowing anisotropic shot coke is the microstructure of a sponge coke represented in FIG. 1 hereof that show a coke microstructure that is composed substantially of non-discrete, or substantially large highly anisotropic flow domains up to about 60 μm or greater in size, typically from about 10 to about 60 μm.

In another aspect of the invention, a metal-containing agent is added to (and/or combined with, and/or contacted with) the feed before or during coking. The agent can be added at one or more of, before or during the oxidizing of the feed, after the feed has been oxidized but before the feed is subjected to pre-heating, during the preheating, after preheating but before the preheated feed is conducted to the coker, while the feed is being conducted to the coker an/or injected into the coker, and during coking. The same metal-containing agent or agents can be added independently at each location or a different agent or agents can be added at each location.

In an embodiment, the metal-containing agent is used at temperatures that will encourage the agent's dispersal in the feed. Such temperatures will typically be from about 70° C. to about 500° C., preferably from about 150° C. to about 500° C., and more preferably from about 185° C. to about 500° C. The agent suitable for use herein can be liquid or solid form, with liquid form being preferred. Non-limiting examples of agents that can be used in the practice of the present invention include metal hydroxides, naphthenates and/or carboxylates, metal cresylates, metal acetylacetonates, a metal sulfide, metal acetate, metal carbonate, high surface area metal-containing solids, inorganic oxides and salts of oxides. Salts that are basic are preferred.

Use of the terms "add", "combine", and "contact" are meant in their broad sense, i.e., that in some cases physical and/or chemical changes in the agent and/or the feed can occur in the agent, the feed, or both when agent is present in the feed. In other words, the invention is not restricted to cases where the agent and/or feed undergo no chemical and/or physical change following or in the course of the contacting and/or combining. An "effective amount" of agent is the amount of agent(s) that when contacted with the feed would result in the formation of a substantially free-flowing coke (preferably a free-flowing shot coke) in the coking zones, preferably substantially all free-flowing shot coke. An effective amount typically ranges from about 100 to about 100,000 ppm (based on the total weight of the metal in the agent and feed), but would depend on the species of agent and its chemical and physical form. While not wishing to be bound by any theory or model, it is believed that the effective amount is less for agent species in a physical and chemical form that lead to better dispersion in the feed than for agent species that are more difficult to disperse. This is why agents that are at least partially soluble in organics, more preferably in the feed, are most preferred.

The metal-containing agent can be selected from organic soluble compounds, organic insoluble compounds, or non-organic dispersible compounds. The least preferred agents are those that result in an undesirable amount of foaming. In an embodiment, the agent is an organic soluble metal compound, such as a metal naphthenate, a metal cresylate or a metal acetylacetonate, and mixtures thereof. Preferred metals are aluminum, potassium, sodium, iron, nickel, vanadium, tin, molybdenum, manganese, cobalt, calcium, magnesium and mixtures thereof. Agents in the form of species naturally present in refinery streams can be used. For such agents, the feed may act as a solvent for the agent, which may assist in dispersing the agent in the feed. Non-limiting examples of agents naturally present in typical feeds include nickel, vanadium, iron, sodium, calcium and mixtures thereof naturally present in certain resid and resid fractions (i.e., certain feed streams), e.g., as porphyrins, naphthenates, etc. The contacting of the agent and the feed can be accomplished by blending a feed fraction containing agent species (including feed fractions that naturally contain such species) into the feed.

In another embodiment, the metals-containing agent is a finely ground solid having a high surface area, a natural material of high surface area, or a fine particle/seed producing agent. Such high surface area materials include alumina, catalytic cracker fines, FLEXICOKER cyclone fines, magnesium sulfate, calcium sulfate, diatomaceous earth, clays, magnesium silicate, vanadium-containing fly ash and the like. The agents may be used either alone or in combination.

Uniform dispersal of the agent into the resid feed is desirable to avoid heterogeneous areas of coke morphology formation. That is, one does not want locations in the coke drum where the coke is substantially free flowing and other areas where the coke is substantially non-free flowing. Dispersing of the agent is accomplished by any number of ways, preferably by introducing a side stream of the agent into the feedstream at the desired location. The agent can be added by solubilization of the agent into the resid feed, or by reducing the viscosity of the resid prior to mixing in the agent, e.g., by heating, solvent addition, etc. High energy mixing or use of static mixing devices may be employed to assist in dispersal of the agent agent, especially agent agents that have relatively low solubility in the feedstream.

Figure 1:
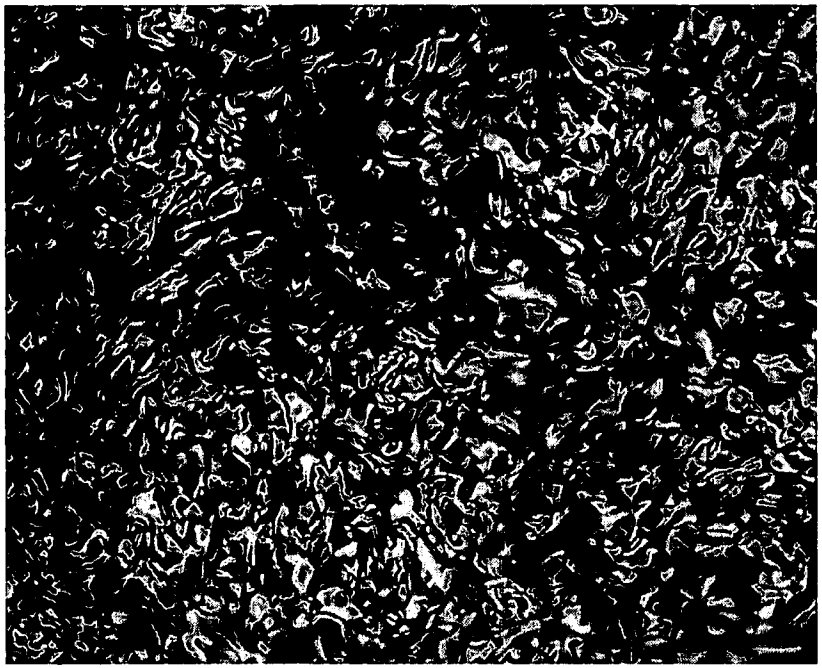
FIG. 1 hereof is a cross-polarized light photomicrograph of coke resulting from a San Joaquin Valley vacuum residuum that was not treated with an oxidizing agent prior to coking. The area of view is 170 microns by 136 microns. Flow domains of 10-30 microns are indicative of sponge coke morphology.

As with the oxidizing agent, the conditions at which the feed is treated with the agent are dependent on the composition and properties of the feed to be coked and the agent used. These conditions can be determined conventionally. For example, several samples of a particular feed containing an agent can be tested at different times and temperatures followed by coking in a bench-scale reactor such as a Microcarbon Residue Test Unit (MCRTU). The resulting coke is then analyzed by use of an optical and/or polarized light microscopy as set forth herein. The preferred coke morphology (i.e., one that will produce substantially free-flowing coke) is a coke microstructure of discrete micro-domains having an average size of about 0.5 to about 10 μm, preferably from about 1 to about 5 μm, somewhat like the mosaic shown in FIG. 2. Coke microstructure that represents coke that is not free-flowing shot coke is shown in FIG. 1 hereof, showing a coke microstructure that is composed substantially of non-discrete, or substantially large flow domains up to about 60 μm or greater in size, typically from about 10 to about 60 μm.

While not wishing to be bound to any specific theory or model, the metal-containing agent or mixture of agents employed are believed to function via one or more of the following pathways: a) as demethylation, dehydrogenation and cross-linking agents when metals present in the feed are converted into metal sulfides that are catalysts for dehydrogenation and shot coke formation; b) agents that add metal-containing species into the feed that influence or direct the formation of shot coke or are converted to species, e.g., metal sulfides, that are catalysts for shot coke formation; c) as particles that influence the formation of shot coke by acting as microscopic seed particles for the shot coke to be formed around, as Lewis acid cracking and cross-linking catalysts, and the like. Agents may also alter or build viscosity of the plastic mass of reacting components so that shear forces in the coker furnace, transfer line and coke drum roll the plastic mass into small spheres. Even though different agents and mixtures of agents may be employed, similar methods can be used for contacting the agent(s) with the feed.

Typically, metal-containing agent(s) are conducted to the coking process in a continuous mode. If needed, the agent could be dissolved or slurried into an appropriate transfer fluid, which will typically be solvent that is compatible with the resid and in which the agent is substantially soluble. The fluid mixture or slurry is then pumped into the coking process at a rate to achieve the desired concentration of agents in the feed. The introduction point of the agent can be, for example, at the discharge of the furnace feed charge pumps, or near the exit of the coker transfer line. There can be a pair of mixing vessels operated in a fashion such that there is continuous introduction of the agents into the coking process.

The rate of metal-containing agent introduction can be adjusted according to the nature of the resid feed to the coker. Feeds that are on the threshold of producing shot coke may require fewer agents than those which are farther away from the threshold.

For metal-containing agents that are difficult to dissolve or disperse in resid feeds, the agent(s) are transferred into the mixing/slurry vessel and mixed with a slurry medium that is compatible with the feed. Non-limiting examples of suitable slurry mediums include coker heavy gas oil, water, etc. Energy may be provided into the vessel, e.g., through a mixer for dispersing the agent.

For metal-containing agents which can be more readily dissolved or dispersed in resid feeds, the agent(s) are transferred into the mixing vessel and mixed with a fluid transfer medium that is compatible with the feed. Non-limiting examples of suitable fluid transfer mediums include warm resid (temperature between about 150° C. to about 300° C.), coker heavy gas oil, light cycle oil, heavy reformate, and mixtures thereof. Cat slurry oil (CSO) may also be used, though under some conditions it may inhibit the agent's ability to produce loose shot coke. Energy may provided into the vessel, e.g., through a mixer, for dispersing the agent into the fluid transfer medium.

The present invention will be better understood by reference to the following examples that are presented for illustrative purposes only and are not to be taken as limiting the invention in any way.

EXAMPLES

General Procedure for Oxidizing Agent Treatment

Approximately 180 g each of five different petroleum residua were added to a 500 cc round bottom flask equipped with a Therm-O-Watch controller, a mechanical blade stirrer, and a condenser attached to a Dean-Stark trap to recover any light ends and water generated during the reaction. The residuum was heated to 180° C., at which time air was introduced into the hot residuum feed under its surface by means of a sparger tube. The temperature was raised and controlled to between about 220° to 230° C. and the flow rate of air was controlled at about 0.675 $ft^3$/hr for three hours or as required depending on the desired degree of oxidation. The sparger tube was removed after the desired time and the flask was allowed to cool to room temperature.

Deasphalting Procedure: A mixture of fresh or oxidized coker feed and n-heptane were added to a 250 cc round bottom flask in a ratio of 1 part feed to 8 parts n-heptane and allowed to stir for 16 hours at room temperature. The mixture was then filtered through a coarse Buchner funnel to separate the precipitated asphaltenes. The solids were dried in a vacuum oven at 100° C. overnight. The heptane was evaporated from the oil/heptane mixture to recover the deasphalted oil. The amount of asphaltenes produced from the oxidized feed was compared to the amount generated from the starting residuum under the same deasphalting procedure. The results are presented in the following table:

TABLE 1

ENHANCEMENTS OF FEED PROPERTIES BY AIR OXIDATION FAVORS FORMATION OF ANISOTROPIC LOOSE SHOT COKE

| | Midcontinent U.S. | | San Joaquin Valley | | LA Sweet | | Maya | | Heavy Canadian | |
|---|---|---|---|---|---|---|---|---|---|---|
| | Raw | Oxidized | Raw | Oxidized | Raw | Oxidized (6 hr) | Raw | Oxidized | Raw | Oxidized |
| Asphaltenes, wt % | 8.9 | 27.0 | 13.6 | 37.8 | 0 | 31.7 | 40.9 | 41.0 | 19.4 | 28.3 |

Microcarbon residue tests were performed on the above feeds to generate cokes to be evaluated by microscopy. The following is the procedure used for the microcarbon tests:

| Heating Profile | Time (min) | $N_2$ Flow (cc/min) |
|---|---|---|
| Heat from room temp to 100° C. | 10 | 66 |
| Heat from 100° C. to 300° C. then to 500° C. | 30 | 66/19.5 |
| Hold at 500° C. | 15 | 19.5 |
| Cool to room temp | 40 | 19.5 |

FIGS. 1 and 2 are cross-polarized light photomicrographs showing the microstructure of the resulting coke from a San Joaquin Valley residuum for both the untreated residuum and the residuum treated with air in accordance with the above procedure. The viewing area for both is 170 microns by 136 microns. The untreated residuum resulted in a coke with a microstructure that was not discrete fine domains. The domains were relatively large (10-30 μm) flow domains. This indicates that sponge coke or a mixture of shot coke and sponge coke will be produced in the coker drum of a delayed coker. The microstructure (FIG. 2) of the resulting coke from the residuum sample that was first air oxidized shows relatively fine (2-5 μm) discrete fine domains indicating that free-flowing shot coke will be produced in the coker drum of a delayed coker. Following the same procedure, the following changes in flow domain sizes were observed: a Midcontinent U.S. Vacuum Resid (10-50 μm to 2-3 μm), a Louisiana Sweet Vacuum Resid (20-60 μm to 2-5 μm) in six hours, a Maya Vacuum Resid (2-10 μm—no change), and a Heavy Canadian Vacuum Resid (10-20 μm to 2-10 μm).

General Procedures for Addition of Metal-Containing Agents into Vacuum Resid Feeds The resid feed is heated to about 70° C. to about 150° C. to decrease its viscosity. The additive (in weight parts per million, wppm) is then added slowly, with mixing, for a time sufficient to disperse and/or solubilize the additive(s) (a "dispersing time"). For laboratory experiments, it is generally preferred to first dissolve and/or disperse the additive in a solvent, e.g., toluene, tetrahydrofuran, or water, and blend it with stirring into the heated resid, or into the resid to which some solvent has been added to reduce its viscosity. The solvent can then be removed. In a refinery, the additive contacts the resid when it is added to or combined with the resid feed. As discussed, the contacting of the additive and the feed can be accomplished by blending a feed fraction containing additive species (including feed fractions that naturally contain such species) into the feed. Additives in the form of organometallic compound(s) are generally soluble in the vacuum resids. To assure maximum dispersion of the additive into the vacuum resid feed, the reaction mixture can be heat soaked. In one example, the appropriate amount of metal acetylacetonate (acac) was dissolved in tetrahydrofuran (THF) under an inert atmosphere, then added to a round bottom flask containing the residuum in which it was to be dispersed. The THF/oil mixture was allowed to stir for 1 hr. at 50° C. to distribute the metal substantially uniformly throughout the resid. The THF was then removed by roto-evaporation to leave the metal acetylacetonate well dispersed in the residuum. A sample of the mixture was analyzed for metals to verify the concentration of metal in the oil was at the target value.

The following tests were conducted using various additives to a resid feed. Additive concentration, heat soak time, and the resulting coke morphology as determined from optical micrographs are set forth in Tables 2-8 below. Control samples of resid with no additive were used by way of comparison.

TABLE 2

EFFECT OF METAL ADDITIVE AGENTS ON MORPHOLOGY OF MCR COKE ON A SPONGE COKE-FORMING VACUUM RESID

| Additive | Concentration (wppm) | Heat Soak at 370° C. (min) | MCR Domain/ Mosaic-Domain Size/Comments (μm) |
|---|---|---|---|
| None | 0 | 30 | 5-30 - Sponge coke |
| Vanadyl Naphthenate | 1,000 | None | 0.5-3 μm very fine to fine mosaic. Shot coke |
| Vanadium Naphthenate | 2,500 | 30 | 0.5-1 μm very fine mosaic - shot coke |
| Vanadium Sulfide | 2,500 | 30 | 5-30 with localized 1-3 μm where VxSy exists |
| Nickel Naphthenate | 1,000 | None | 1-5 μm fine mosaic - Shot coke |
| Nickel Naphthenate | 2,500 | None | 0.5-3 μm very fine to fine mosaic. Shot coke |
| Sodium Naphthenate | 2,500 | None | 0.5-4 μm very fine to fine mosaic. Shot coke |
| Iron Chloride | 2,500 | 30 | 5-25 with localized 1-3 μm where sulfide exists - Illustrates effect of heterogeneity |
| Iron Acetyl-acetonate | 10,000 | 30 | 0.5-3 μm very fine mosaic. Shot coke |
| Vanadyl Acetyl-acetonate | 10,000 | 30 | <0.5 μm ultra fine mosaic. Shot coke |

TABLE 2-continued

EFFECT OF METAL ADDITIVE AGENTS ON MORPHOLOGY OF MCR COKE ON A SPONGE COKE-FORMING VACUUM RESID

| Additive | Concentration (wppm) | Heat Soak at 370° C. (min) | MCR Domain/ Mosaic-Domain Size/Comments (μm) |
|---|---|---|---|
| Vanadyl Acetyl-acetonate | 1,000 | 30 | 0.5-2 μm very fine mosaic. Shot coke |
| Nickel Acetyl-acetonate | 10,000 | 30 | 0.5-2 μm very fine mosaic. Shot coke |
| Nickel Acetyl-acetonate | 1,000 | 30 | 1-4 μm fine/medium mosaic. Shot coke |
| Mixture of Nickel and Vanadyl Acetyl-acetonates | 5,000 ppm Ni 5,000 ppm V | 30 | <0.5-0.7 μm ultra fine mosaic. Shot coke |
| Mixture of Iron and Vanadyl acetyl-acetonates | 5,000 ppm Fe 5,000 ppm V | 30 | <0.5-1 μm very fine mosaic. Shot Coke |
| Mixture of Iron and Nickel acetyl-acetonates | 5,000 ppm Fe, 5,000 ppm Ni | 30 | 0.5-3 μm fine mosaic. Shot coke. |

TABLE 3

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Oil Soluble Additives | | | | | |
| 100-1 | None | — | 14.43, 15.45, 14.40, 14.50 | Flow domains (10–35 μm) & coarse mosaic (5–10 μm) | Sponge |
| 113-11 | Vanadyl Naphthenate[1] | 2500 | 13.46 | Extra fine mosaic (0.5–1.5 μm) | Shot |
| 113-1 | Vanadyl Naphthenate | 1000 | 14.22 | Very fine mosaic (0.5–2 μm) | Shot |
| 121-3 | Vanadyl Naphthenate | 500 | 15.31 | Very fine mosaic (0.5–3 μm) | Shot |
| 126-4 | Vanadyl Naphthenate | 300 | 15.38 | Fine/Medium mosaic (1–5 μm) | Shot |
| 113-14 | Sodium Naphthenate | 2500 | 12.50 | Very fine mosaic (0.5–3 μm) | Shot |
| 113-4 | Sodium Naphthenate | 1000 | 12.20 | Fine/medium mosaic (1–4 μm) | Shot |
| 121-4 | Sodium Naphthenate | 500 | 13.17 | Fine/Medium mosaic (1.5–6 μm) | Shot |
| 125-5 | Sodium Naphthenate | 300 | 14.29 | Medium/Coarse mosaic (2–10 μm) | Shot |
| 113-13 | Nickel Naphthenate | 2500 | 14.36 | Very fine mosaic (0.5–3 μm) | Shot |
| 113-3 | Nickel Naphthenate | 1000 | 13.71 | Fine/medium mosaic (1–4 μm) | Shot |
| 127-3 | Sodium Cresylate | 1000 | 13.37 | Fine/medium mosaic (1–4 μm) | Shot |
| 127-2 | Sodium Cresylate | 500 | 12.68 | Coarse mosaic/domains (3–15 μm) with localized regions 0.5–4 μm. | Transition |
| 131-5 | Sodium Cresylate on Heavy Canadian Transition Coke-former[3] | 430[2] | 19.90 | Fine mosaic (0.5–3 μm) | Shot |
| 118-6 | Vanadyl Acetyl-acetonate[2] | 3000 | 18.05 | — | Shot |
| 142-2 | Vanadyl Acetyl-acetonate[2] | 1000 | 16.90 | Very fine mosaic (0.5–2.5 μm) | Shot |
| 142-1 | Nickel Acetyl-acetonate[2] | 1000 | 16.51 | Very fine/fine mosaic (0.5–4 μm) | Shot |
| 118-13 | Vanadyl tetraphenylporphine | 1000 | 17.05 | Extra fine mosaic (<0.5–1 μm) | Shot |
| 118-10 | Nickel tetraphenylporphine | 1000 | 17.93 | Very fine mosaic (0.5–3 μm) | Shot |

[1]The naphthenate additives, dissolved in 3–5 mL of toluene were added slowly to the stirring vacuum resid at 100–125° C. Stirring was continued for 30 min and the toluene solvent was evaporated under a nitrogen flow to the tare weight of the resid plus additive.
[2]Acac's were THF solubilized and added into the vacuum resid at 40° C. THF was removed under vacuum at 40–60° C.

TABLE 4

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Blender as Aqueous solution | | | | | |
| 136-1 | Sodium Chloride | 1000 | 14.1 | Flow Domains (10–20 μm) with isolated areas of fine/medium mosaic (1–5 μm) | Sponge |

TABLE 4-continued

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| 136-2 | Sodium Sulfate | 1000 | 15.7 | Flow Domains (10–20 μm) with isolated areas of fine/medium mosaic (1–4 μm) | Transition |
| 136-3 | Sodium Sulfide | 1000 | 15.2 | Fine/Medium mosaic (0.5–3 μm) | Shot |
| 136-4 | Sodium Acetate | 1000 | 13.4 | Fine/Medium mosaic (1–5 μm) | Shot |
| 136-5 | Ferric Chloride | 1000 | 13.0 | Flow Domains (10–20 μm) with isolated areas of fine/medium mosaic (1–5 μm) | Transition |
| 136-6 | Zinc Chloride | 1000 | 14.1 | Flow Domains (10–20 μm) with isolated areas of fine/medium mosaic (1–5 μm) | Sponge/ some Transition |
| 136-7 | Sodium Hydroxide | 1000 | 14.4 | Fine/Medium mosaic (0.5–4 μm) | Shot |
| 136-9 | Potassium Hydroxide | 1000 | 13.6 | Very Fine mosaic (0.5–2.5 μm) | Shot |
| 136-10 | Lithium Hydroxide | 1000 | 12.6 | Fine/Medium mosaic (0.5–5 μm) with extensive regions of coarse mosaic (5–10 μm) | Transition |

The required amount of Additive agent dissolved in 20 mL of water at 80° C. was slowly added to the vacuum resid in a blender at 100–125° C. The mixture was blended until homogeneous. Water was evaporated under a nitrogen flow while raising the temperature of the mixture to 150° C.

TABLE 5

EFFECT OF METAL ADDITIVE AGENTS ON MORPHOLOGY OF MCR COKE ON A SPONGE COKE-FORMING VACUUM RESID

| Sample No. | Additive | Additive (wppm) | MCR (wt %) | Microscopy on MCR Coke: Domain/Mosaic Size (μm) | Coke Type |
|---|---|---|---|---|---|
| Blender as Slurry[1] | | | | | |
| 137-1 | Vanadium Pentoxide | 1000 | 14.2 | Flow Domains (10–20 μm) and medium/coarse mosaic (3–10 μm) | Sponge |
| 137-2 | FLEXICOKER Fines | 1000 – V | 20.3 | Coarse mosaic (5–10 μm) with areas of fine/medium mosaic (1–5 μm) | Transition |
| 137-5 | Tin Powder | 1000 | 13.8 | Flow Domains (10–25 μm) with coarse mosaic (5–10 μm) | Sponge |
| 137-6 | Zinc Powder | 1000 | 16.1 | Domains (10–25 μm) and coarse mosaic (5–10 μm). Isolated areas of fine/medium mosaic (1–5 μm). | Sponge/ Transition |
| 140-10 | Cesium Hydroxide | 1000 | 14.3 | Medium/Coarse mosaic (2–10 μm); ~1/3 molar equiv of Na. | Shot |
| 142-14 | Cesium hydroxide | 3,400 | 15.3 | Very fine mosaic (0.5–2 μm). | |
| 140-8 | Ferric Oxalate hydrate | 1000 | 15.0 | Flow Domains (10–30 μm) and isolated areas of fine/medium mosaic (1–5 μm). | Transition |
| 140-5 | Ferric Acetate | 1000 | 13.5 | Flow Domains (10–30 μm) and isolated areas of fine/medium mosaic (1–5 μm). | Transition |
| 140-6 | Zinc Acetate | 1000 | 13.9 | Flow Domains (10–35 μm) and coarse mosaic (5–10 μm). | Sponge |
| 140-9 | Zinc Oxalate | 1000 | 15.5 | Flow Domains (10–35 μm) and coarse mosaic (5–10 μm). | Sponge |
| 140-7 | Iron Naphthenate | 1000 | 14.1 | Fine/Medium mosaic (1–5 μm) and some coarse mosaic (5–10 μm) | Shot |

[1]Blended as a slurry at 150° C. without solvent

TABLE 6

EFFECT OF METAL ADDITIVE AGENTS ON MORPHOLOGY OF MCR COKE ON A SPONGE COKE-FORMING VACUUM RESID

| Sample No. | Additive | Additive (wppm M) | MCR (wt %) | Microscopy on MCR Coke: Domain/Mosaic Size (μm) | Coke Type |
|---|---|---|---|---|---|
| 142-3 | Fe Acetyl-acetonate | 1000 | 14.8 | Very fine mosaic (1–5 μm), some coarse mosaic (5–10 μm) | Transition |
| 114-2 | Fe Acetyl-acetonate | 1000 | 15.4 | Very fine mosaic (0.5–3 μm) | Shot |
| 22-2 | Ni Acetyl-acetonate + Fe Acetyl-acetonate | 500 + 500 | 15.6 | Very fine mosaic (0.5–3 μm) | Shot |
| 122-1 | V Acetyl-acetonate + Fe Acetyl-acetonate | 500 + 500 | 15.1 | Very fine mosaic (<0.5–1 μm) | Shot |
| 121-1 | Calcium Naphthenate | 1000 | 14.6 | Flow domains (10–25 μm) and coarse mosaic (5–10 μm) | Sponge |
| 121-2 | Calcium Naphthenate | 2500 | 14.1 | Flow domains (10–15 μm) and coarse mosaic (5–10 μm) | Sponge/ Transition |

TABLE 6-continued

EFFECT OF METAL ADDITIVE AGENTS ON MORPHOLOGY OF MCR COKE ON A SPONGE COKE-FORMING VACUUM RESID

| Sample No. | Additive | Additive (wppm M) | MCR (wt %) | Microscopy on MCR Coke: Domain/Mosaic Size (μm) | Coke Type |
|---|---|---|---|---|---|
| 150-2 | Calcium Acetyl-acetonate | 5000 | 14.6 | Small domains (10–15 μm) and medium/coarse mosaic (2–10 μm) | Transition |
| 125-12 | Calcium acetate | 5000 | 15.6 | Coarse mosaic/small domains (5–15 μm) with abundant localized fine domains (0.5–3 μm) | Transition |
| 125-13 | Calcium acetate | 1000 | 14.6 | Coarse mosaic/small domains (5–15 μm) with minor localized fine/medium mosaic (1–4 μm) | Sponge |
| 144-8 | Sodium sulfonate | 500 | 14.4 | Flow domains (10–25 μm) and isolated areas of fine/medium mosaic (1–5 μm) | Transition |
| 144-9 | Calcium sulfonate | 500 | 16.3 | Coarse mosaic domains (5–15 μm) and abundant areas of fine/medium mosaic (1–5 μm) | Transition |
| 146-1 | Sodium hydrosulfide | 1000 | 23.4 | Medium/coarse mosaic (2–10 μm) | Shot |
| 146-2 | Sodium borate | 1000 | 14.9 | Flow domains (10–30 μm) and areas of coarse mosaic (5–10 μm) | Sponge |
| 146-3 | Potassium borate | 1000 | 13.0 | Flow domains (10–30 μm) and areas of coarse mosaic (5–10 μm) | Sponge |
| 146-4 | Ferric sulfate | 1000 | 14.7 | Flow domains (10–30 μm) and areas of coarse mosaic (5–10 μm) | Sponge |
| 146-5 | Ferric acetate | 1000 | 14.5 | Small domains (10–20 μm) and areas of medium/coarse mosaic (2–10 μm) | |
| 146-12 | Zinc Naphthenate | 1000 | 13.24 | Domains/coarse mosaic (10–15 μm) and isolated areas of fine/medium mosaic (1–5 μm) | Sponge |
| 144-11 | Mn porphyrin | 1000 | 15.2 | Medium/coarse mosaic (2–10 μm) and areas of fine/medium mosaic (1–5 μm) | Transition/ Shot |
| 144-10 | Porphine - NO METALS | 3000 | 14.6 | Coarse mosaic domains (5–20 μm) and areas of fine/medium mosaic (1–5 μm) | Transition |

Acac's were THF solubilized and added into the vacuum resid at 40° C. THF was removed under vacuum at 40–60° C. Calcium salts were dissolved in water and blended into the resid at 100–125° C.

TABLE 7

EFFECT OF METAL ADDITIVE AGENTS ON MORPHOLOGY OF MCR COKE OF A TRANSITION COKE-FORMING[1] VACUUM RESID

| Sample No. | Additive | Additive (wppm M) | MCR (wt %) | Microscopy on MCR Coke: Domain/Mosaic Size (μm) | Coke Type |
|---|---|---|---|---|---|
| 144-13 | Heavy Canadian | — | 16.0 | | |
| 142-8 | Sodium hydroxide | 250 | 19.8 | Fine/medium mosaic (0.5–4 μm) | Shot |
| 142-5 | Sodium cresylate | 250 | 19.4 | Fine/medium mosaic (0.5–6 μm) | Shot |
| 142-13 | Sodium sulfonate | 250 | 16.7 | Fine/medium mosaic (1–7 μm) | Shot |
| 142-9 | Potassium hydroxide | 250 | 20.5 | Fine/medium mosaic (0.5–6 μm) | Shot |
| 142-6 | Potassium cresylate | 250 | 16.5 | Fine/medium mosaic (1–7 μm) | Shot |
| 142-10 | Calcium hydroxide | 250 | 20.6 | Fine/medium mosaic (1–7 μm) | Shot |
| 142-12 | Calcium sulfonate | 250 | 19.8 | Medium/coarse mosaic (2–9 μm) | Shot |
| 144-1 | Sodium hydroxide | 500 | 21.4 | Fine/medium mosaic (0.5–3 μm) | Shot |
| 144-2 | Sodium cresylate | 500 | 19.9 | Fine/medium mosaic (0.5–5 μm) | Shot |
| 144-3 | Sodium sulfonate | 500 | 17.6 | Fine/medium mosaic (0.5–6 μm) | Shot |
| 144-4 | Potassium hydroxide | 500 | 19.3 | Fine/medium/coarse mosaic (1–10 μm) | Shot |
| 144-5 | Potassium cresylate | 500 | 20.8 | Fine/medium mosaic (1–6 μm) | Shot |
| 144-6 | Calcium hydroxide | 500 | 20.8 | Fine/medium mosaic (1–6 μm) | Shot |
| 144-7 | Calcium sulfonate | 500 | 19.3 | Fine/medium mosaic (1–7 μm) | Shot |

Dissolved in water, heated to 80° C. and blended into resid at 100–125° C. in a blender.

[1]Supplemented by 250 ppm V and 106 ppm Ni naturally occurring in this resid

TABLE 8

MISCELLANEOUS

| Sample No. | Additive | Additive (wppm M) | MCR (wt %) | Microscopy on MCR Coke: Domain/Mosaic Size (μm) | Coke Type |
|---|---|---|---|---|---|
| 140-1 | 75% Maya: 25% CHAD | | 22.4 | Fine/Medium mosaic (1–7 μm) | Shot |
| 142-2 | CHAD + sodium acetate | 1,000 | 13.6 | Fine/Medium mosaic (1–6 μm) | Shot Coke |
| 142-3 | CHAD + iron naphthenate | 1,000 | 11.3 | Fine/Medium mosaic (1–7 μm) | Shot Coke |
| 146-6 | Heavy Canadian + sodium acetate | 250 | 21.4 | Fine/medium mosaic (0.5–5 μm) | Shot |

TABLE 8-continued

MISCELLANEOUS

| Sample No. | Additive | Additive (wppm M) | MCR (wt %) | Microscopy on MCR Coke: Domain/Mosaic Size (μm) | Coke Type |
|---|---|---|---|---|---|
| 146-7 | Heavy Canadian + potassium acetate | 250 | 18.2 | Medium/Coarse mosaic (1–8 μm) | Shot |
| 146-8 | Off-Shore Marlim | — | 18.2 | Flow domains (10–60 μm) | Sponge |
| 146-9 | Off-Shore Marlim + NaOH | 500 | 17.5 | Domain/coarse (5–20 μm) and isolated areas of fine/medium mosaic (1–5 μm) | Transition |
| 146-10 | Off-Shore Marlim + NaOH | 1000 | 17.9 | Medium/coarse mosaic (1–8 μm) and isolated areas of fine/medium mosaic (0.5–3 μm) | Shot |

*NHI = n-heptane insolubles (asphaltenes)

The Heavy Canadian feed used in the examples herein contained 250 wppm V, 106 wppm Ni, 28 wppm Na, and 25 wppm Fe.

The Maya feed contained 746 wppm V, 121 wppm Ni, 18 wppm Na, and 11 wppm Fe.

The Off-Shore Marlim feed contained 68 wppm V, 63 wppm Ni, 32 wppm Na, and 25 wppm Fe.

The Chad feed contained 0.7 wppm V, 26 wppm Na, 31 wppm Ni, and 280 wppm Fe.

Polarizing light microscopy was used in these examples for comparing and contrasting structures of green coke (i.e., non-calcined coke) samples.

At the macroscopic scale, i.e., at a scale that is readily evident to the naked eye, petroleum sponge and shot green cokes are quite different—sponge has a porous sponge-like appearance, and shot coke has a spherical cluster appearance. However, under magnification with an optical microscope, or polarized-light optical microscope, additional differences between different green coke samples may be seen, and these are dependent upon amount of magnification.

For example, utilizing a polarized light microscope, at a low resolution where 10 micrometer features are discernable, sponge coke appears highly anisotropic, the center of a typical shot coke sphere appears much less anisotropic, and the surface of a shot coke sphere appears fairly anisotropic.

At higher resolutions, e.g., where 0.5 micrometer features are discernable (this is near the limit of resolution of optical microscopy), a green sponge coke sample still appears highly anisotropic. The center of a shot coke sphere at this resolution is now revealed to have some anisotropy, but the anisotropy is much less than that seen in the sponge coke sample.

It should be noted that the optical anisotropy discussed herein is not the same as "thermal anisotropy", a term known to those skilled in the art of coking. Thermal anisotropy refers to coke bulk thermal properties such as coefficient of thermal expansion, which is typically measured on cokes which have been calcined, and fabricated into electrodes.

The invention claimed is:

1. An improved delayed coking process comprising:

a) adding an oxidizing agent to a heavy oil residual feed stream and maintaining the feed at an oxidizing temperature for an oxidizing time sufficient to significantly increase the amount of asphattenes and organically-bound oxygen in the feed in order to make an oxidized feed;

b) pre-heating the oxidized feed to a pre-heat temperature;

c) conducting the pre-heated oxidized feed to a coking vessel and coking the pre-heated oxidized feed in the vessel at a coking pressure and a coking temperature for a coking time to form a substantially free-flowing anisotropic coke product;

d) conducting volatiles away from the process; and e) after the coking time, removing the free-flowing coke product from the vessel;

wherein a metal-containing agent is added to the feed prior to step (e).

2. The process of claim 1 wherein the oxidizing agent is selected from air, oxygen, ozone, hydrogen peroxide, organic peroxides, hydroperoxides, inorganic peracids, inorganic oxides and peroxides and salts of oxides, sulfuric acid, and nitric acid.

3. The process of claim 2 wherein the heavy oil residual feed is resid and wherein the oxidizing agent is selected from air, oxygen, and ozone.

4. The process of claim 3 wherein the oxidizing agent is air.

5. The process of claim 3 wherein the oxidizing temperature ranges from about 150° C. to about 375° C., and the oxidizing time ranges from about 20 minutes to about 5 hours.

6. The process of claim 1 wherein an aqueous metal-containing caustic is added to the residual feed stream before, during, or after the time that the feed is heated to coking temperatures.

7. The process of claim 6 wherein the metal-containing aqueous caustic is added to the residual feed stream after the time that the feed is heated to the coking temperature.

8. The process of claim 1 wherein the particle size of the shot coke is from about 1/16 to about 3/8 inch.

9. The process of claim 1 wherein the microstructure of the resulting substantially free-flowing anisotropic coke is characterized as being comprised of substantially discrete domains from about 0.5 to about 10 μm in average size.

10. The process of claim 3 wherein the metal-containing agent is added to the feed at a feed temperature ranging from about 70° C. to about 500° C.

11. The process of claim 3 wherein the metal-containing agent is one or more of metal hydroxides, metal cresylates, metal naphthenates and/or metal carboxylates, metal acetylacetonates, Lewis acids, a metal sulfide, metal acetate, metal carbonate, high surface area metal-containing solids, inorganic metal oxides and salts of metal oxides.

12. The process of claim 3 wherein the metal-containing agent is in the form of a basic salt.

13. The process of claim 3 wherein the pressure during pre-heat ranges from about 50 to about 550 psig, and pre-heat temperature ranges from about 480° C. to about 520° C.

14. The process of claim 3 wherein the coking pressure ranges from about 15 psig to about 80 psig, coking temperature ranges from about 410° C. to about 475° C., and coking time ranges from about 0.5 hour to about 14 hours.

15. The process of claim 3, further comprising the step of quenching the free-flowing coke in the vessel with water before the removing of the coke from the vessel.

16. The process of claim 3, wherein the metal-containing agent is added to the feed at at least one of (i) prior to step (a), (ii) during step (a), (iii) after step (a) but before step (b), (iv) during step (b), (v) after step (b) but before step (c), and/or (vi) during step (c).

17. The process of claim 3, further comprising during step e), f) conducting the pre-heated oxidized feed to a second coking vessel and coking the pre-heated oxidized feed in the second vessel at a coking pressure and a coking temperature for a coking time to form a substantially free-flowing anisotropic coke product;

g) conducting volatiles away from the second coking vessel; and h) after the coking time, removing a the substantially free-flowing coke from the second vessel;

wherein a metal-containing agent is added to the feed to the second vessel prior to step h).

18. The process of claim 3 in which the heavy oil residual feed has a nominal initial boiling point of at least about 525° C.

* * * * *